US005423194A

United States Patent [19]

Senecal

[11] Patent Number: 5,423,194

[45] Date of Patent: Jun. 13, 1995

[54] CHILLED SERVICE BOWL

[75] Inventor: Lise Senecal, St-Janvier, Canada

[73] Assignee: Valany Marketing Inc., Palm Beach Gardens, Fla.

[21] Appl. No.: 137,906

[22] Filed: Oct. 15, 1993

[51] Int. Cl.[6] ..... A47F 3/04

[52] U.S. Cl. ..... 62/457.6; 62/458

[58] Field of Search ..... 62/457.1, 457.6, 457.9, 62/458, 371, 331

[56] References Cited

U.S. PATENT DOCUMENTS

| | | | |
|---|---|---|---|
| 2,241,853 | 5/1941 | Hall et al. | 62/458 |
| 2,258,906 | 10/1941 | Powers | 62/458 |
| 2,446,686 | 8/1948 | Behrens | 62/458 |
| 2,915,884 | 12/1959 | Haushalter et al. | 62/458 |
| 3,555,848 | 1/1971 | Johnson | 62/457.9 |
| 4,019,339 | 4/1977 | Anderson | 62/255 |
| 4,506,799 | 3/1985 | Mason, Jr. | 220/69 |

FOREIGN PATENT DOCUMENTS

| | | | |
|---|---|---|---|
| 551916 | 6/1932 | Germany | 62/457.9 |

*Primary Examiner*—Henry A. Bennet

*Assistant Examiner*—William C. Doerrler

*Attorney, Agent, or Firm*—McHale & Slavin

[57] ABSTRACT

The instant invention is directed to a counter-top service bowl for chilling various foods and beverages. A miniaturized refrigeration system is secured to the outer surface of the bowl having an evaporator coil disposed within a coil chamber. Air is directed through the chamber and into the middle of the bowl cavity. At the bottom of the bowl is a series of holes lining the bottom of the bowl for induction back into the circulation chamber. In operation the bowl acts as a chiller wherein solid foods such as fruit is chilled by air circulation and associated contact along the surface of the bowl. A bowl liner insertable into the base bowl permits placement of non-solid foods such as fruit salads. The bowl liner seals the circulation chamber forcing air past an evaporator coil and outward through an exhaust port. The bowl liner can be removed for use as a conventional bowl and returned to maintain the chilled condition. A transparent cover allows for increased efficiency of the cooling system while various bowl inserts allow placement and chilling of peculiar beverage containers such as wine bottles.

7 Claims, 5 Drawing Sheets

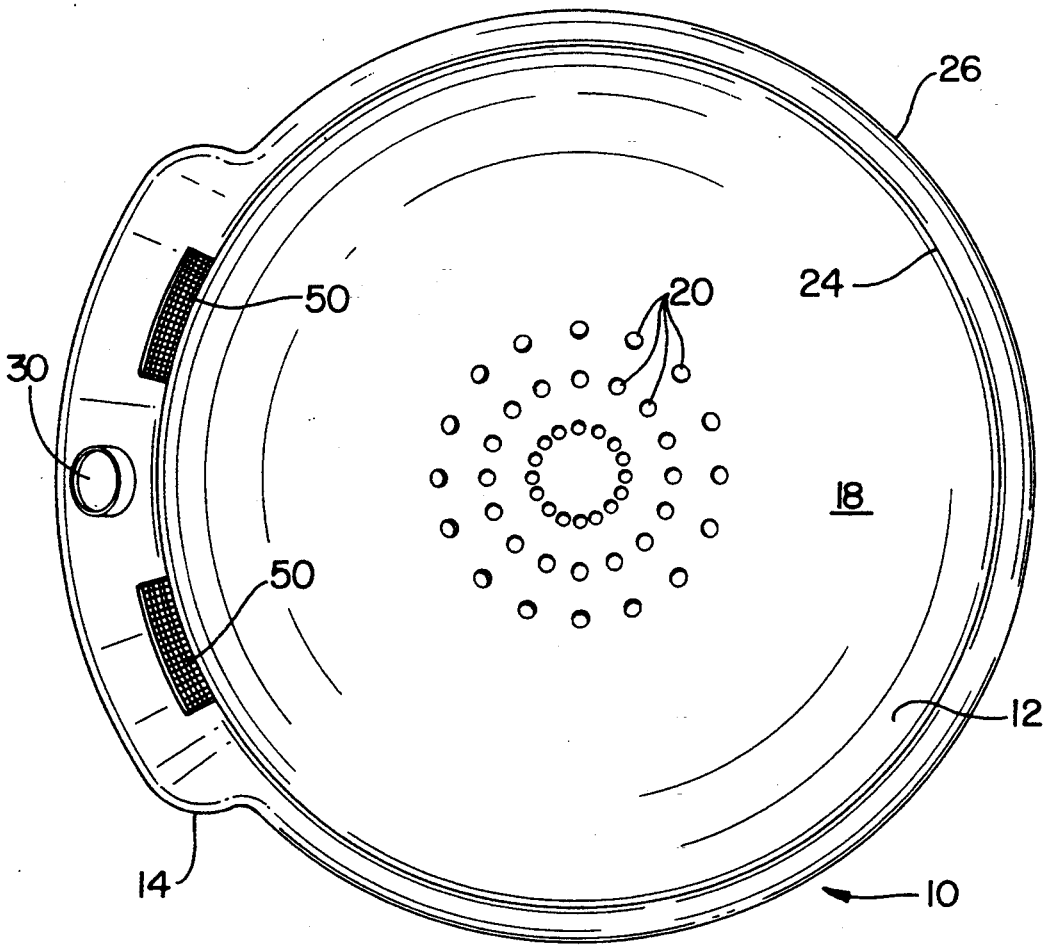
FIG. 1
FIG. 2
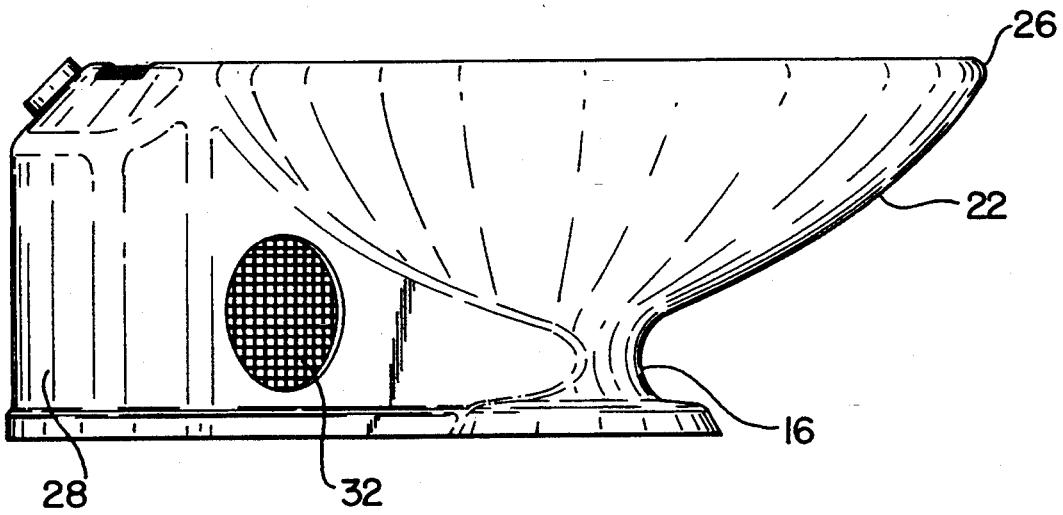

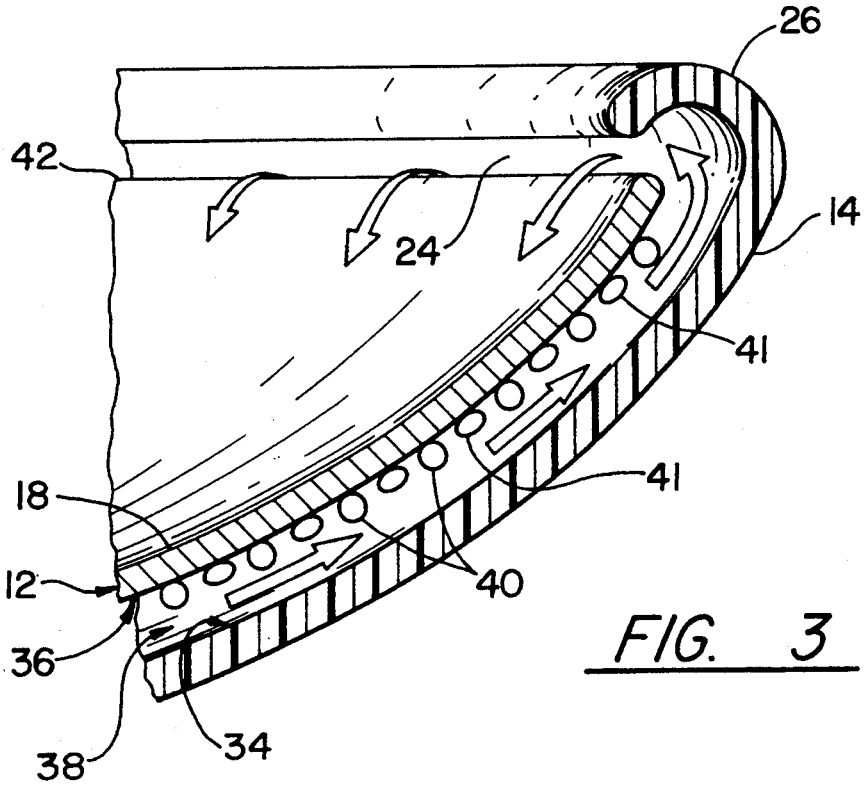
FIG. 3
FIG. 4
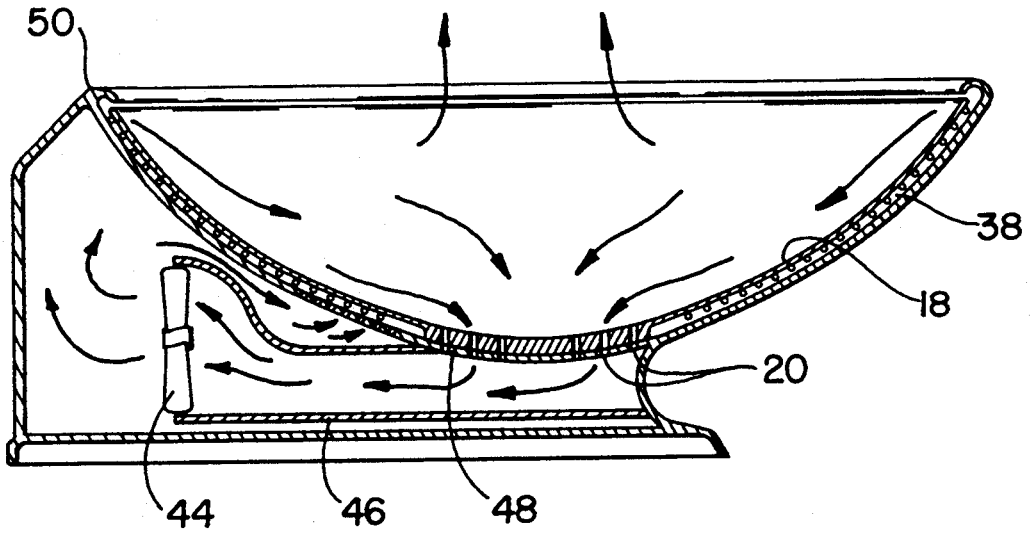

FIG. 6A
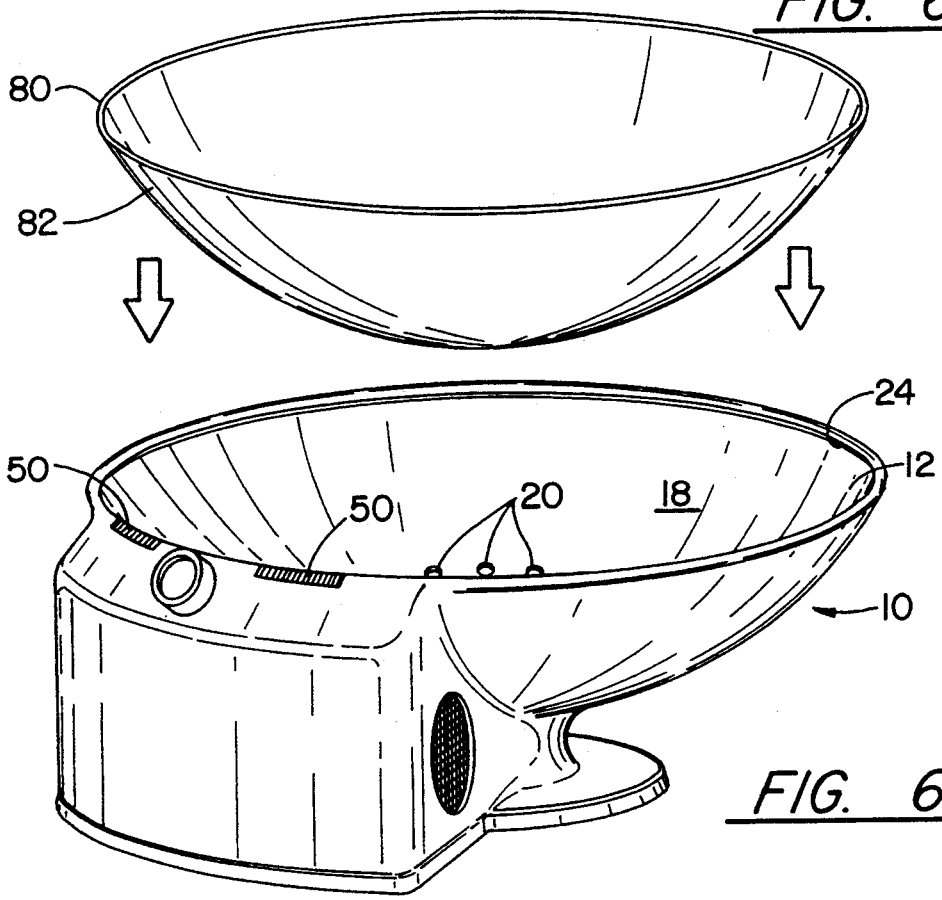
FIG. 6
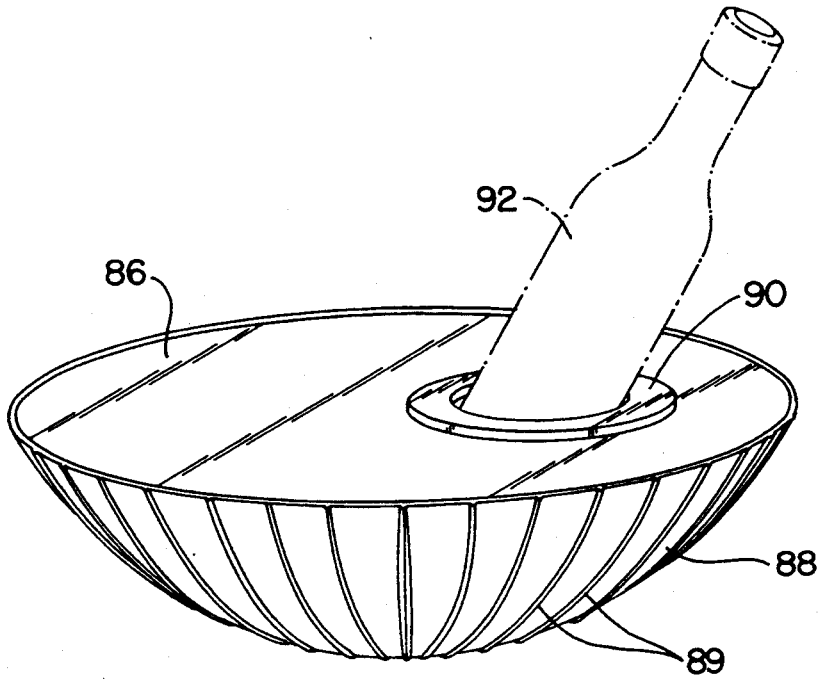
FIG. 7

CHILLED SERVICE BOWL

BACKGROUND OF THE INVENTION

1. Field of the Invention

This invention relates generally to the service of food and beverages in a chilled state and, more particularly, to a portable service bowl and support structure capable of chilling food and/or beverages.

2. Description of the Prior Art

Food is typically served in either a warm or cold state. Food served warm must be consumed quickly to prevent heat loss. If a more leisurely meal is desired, warming plates can be utilized to keep the food warm until consumption. Likewise, beverages are also served hot or cold. Hot beverages; such as coffee and tea can be kept hot by use of insulated containers whereas ice is conventionally used for chilling of soft drinks, water, and so forth.

What is lacking in the art is a device capable of keeping foods and beverages chilled without the use of ice or conventional refrigeration. For instance, fruit salad is a food that requires refrigeration until use to prevent spoilage. However, if a leisurely meal is desired, the salad must be left in the refrigerator and retrieved by the host at the time of service. In many instances a salad or the like food is a focal point of the meal, for purpose of display or consumption, and must be placed at the dining table throughout the meal. Presently the method of chilling is a layer of ice in which a bowl containing the salad is placed. Problems with storing the salad on a layer of ice are apparent wherein removal of the bowl from the layer of ice allows melting ice to drip from the base of the bowl. This is especially troubling if the bowl is passed around the table. Alternatively, if the salad bowl is left stationary, retrieval of food requires service by the individual closest to the bowl disrupting the server's meal as well as the remainder of guests seated at the table.

Further lacking in the art is a device capable of maintaining fresh fruit when displayed on a kitchen countertop. For instance, fresh fruit is typically chilled until consumption, refrigeration preventing premature spoilage of the fruit. For this reason, modern refrigerators include the use of at least one fresh fruit storage bin. Apples, pears, plums, oranges, peaches, grapes, are just a few types of fresh fruit that will spoil within days if stored at normal room temperature yet will stay fresh for weeks if refrigerated. However, fruit stored in a refrigerator bin is easily forgotten and difficult for young children to obtain. For this reason the decision must be made to maintain the fruit in the refrigerator or risk spoilage by counter-top display of the fruit allowing for viewing and accessibility of the fruit.

Fruit bowls are so named for their characteristically high side walls. Problems with the fruit bowl include lack of air circulation which further increase spoilage and inability to maintain the fruit in a chilled condition. One known device that attempted to address this problem is U.S. Pat. No. 4,506,799 issued to Mason which discloses a conical shaped bowl having a plurality of ribs to minimize surface contact so as to form channels for the flow of air thus reduces spoilage by air circulation. The Mason patent fails to teach chilling of the fruit.

Yet still further lacking in the art is a device capable of chilling various beverages. While ice can be added to many beverages to chill the fluid, in many instances the taste of the beverage may be diluted if ice is added. For instance, ice is never added directly to fine wine, rather, the wine bottle is placed in a bucket of ice. Similarly, punch is most desirable if served cold but the addition of ice directly into the punch bowl may cause undesirable dilution. Placement of ice around the punch bowl requires a container larger than the punch bowl capable of holding the melted ice.

Thus, the problem with the prior art, to which this invention addresses is the maintenance of food and beverages in a chilled state without the need for conventional refrigeration or placement of said food and beverages upon a bed of ice. It is, therefore, to the effective resolution of these needs and problems associated therewith that the present invention is directed.

SUMMARY OF THE INVENTION

The instant invention is directed to an improved service bowl for chilling various foods and beverages. The service bowl incorporates a lightweight support structure housing a miniaturized refrigeration system allowing placement on a counter-top or serving table. A base bowl formed within the underlying structure utilizes an evaporator coil wrapped around the outer surface of the base bowl for removal of heat from the cavity of the bowl. A circulating fan directs air upward through a chamber that lines the base bowl and evaporator coil. An upper edge of the chamber consists of a directional opening regulating chamber air into the bowl cavity. Excess heat rises while the cooler air sinks to the bottom of the bowl wherein a series of holes lines the bottom of the bowl for induction back into the circulation chamber.

In operation the bowl is a food chiller wherein solid foods such as fruit is chilled by air circulation and associated contact along the surface of the bowl. The air circulation encompasses the fruit from top to the bottom of the bowl. Alternatively, a solid bowl liner is insertable into the base bowl to permit placement of non-solid foods such as the aforementioned fruit salad. The outer surface of the bowl liner seals the directional opening forcing air past the evaporator coil only once before compelled through an exhaust port, the exhaust port opening automatically upon an increase of air pressure in the chamber.

The bowl liner can be easily removed for use as a conventional bowl and returned to maintain the chilled condition. Use of a conventional bowl within the base bowl does not defeat the intent of the invention as chilling continues by exposure to the chamber air, only a loss in operating efficiency result. The use of a cover increases efficiency of the cooling system and, when used in combination with the specially shaped bowl liner, provides temperature equaling that of a conventional refrigerator.

In addition, the disclosed cover includes a formable seal along a portion of the cover allowing the neck of any sized bottled beverage to extend therethrough. Thus, the base bowl operates as a chilling chamber in place of a bucket of ice. Further, an alternative to the base bowl is disclosed having various sized bottle holders.

Accordingly, it is a primary object of this invention to provide a lightweight, self-contained chiller for storage of perishable foods, the chiller can be placed on a counter-top or serving table.

Another object of the instant invention is to provide a bowl liner operatively associated with the chiller for placement of non-solid foods further acting as a service bowl for serving of food chilled in the bowl liner.

Yet another object of the instant invention is to teach the use of a cover for increased chilling efficiency and providing a means for chilling bottled beverages by use of cover allowing a portion of the bottle to extend therethrough while chilling the remainder of the bottle.

Yet still another object of the instant invention is to teach the use of a slidable cover allowing the removal of food from the bowl with displacement of the cover.

Another object of the instant invention is to provide and alternative embodiment allowing the bowl to be used for heating of foods.

Still another object of the instant invention is to teach the use of an auxiliary exhaust port that is opened upon increased chamber air pressure sensing the use of a bowl liner and quieting the operation of the chiller as the use of the bowl liner indicates the device will be used during table service.

Still another object of the instant invention is to provide an apparatus that is compact and aesthetically pleasing allowing placement on the counter-tops of the most discriminating consumer.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

BRIEF DESCRIPTION OF THE DRAWINGS

FIG. 1 is a top view of the instant invention;

FIG. 2 is a side view;

FIG. 3 is a partial cross sectional view of the air circulation chamber;

FIG. 4 is a cross sectional side view;

FIG. 6 is a perspective view with a bowl liner ready for installation;

FIG. 6A is a perspective view of the bowl liner;

FIG. 7 is a perspective view of an alternative bowl liner available for use with a beverage bottle;

PREFERRED EMBODIMENT OF THE INVENTION

Figure 5:
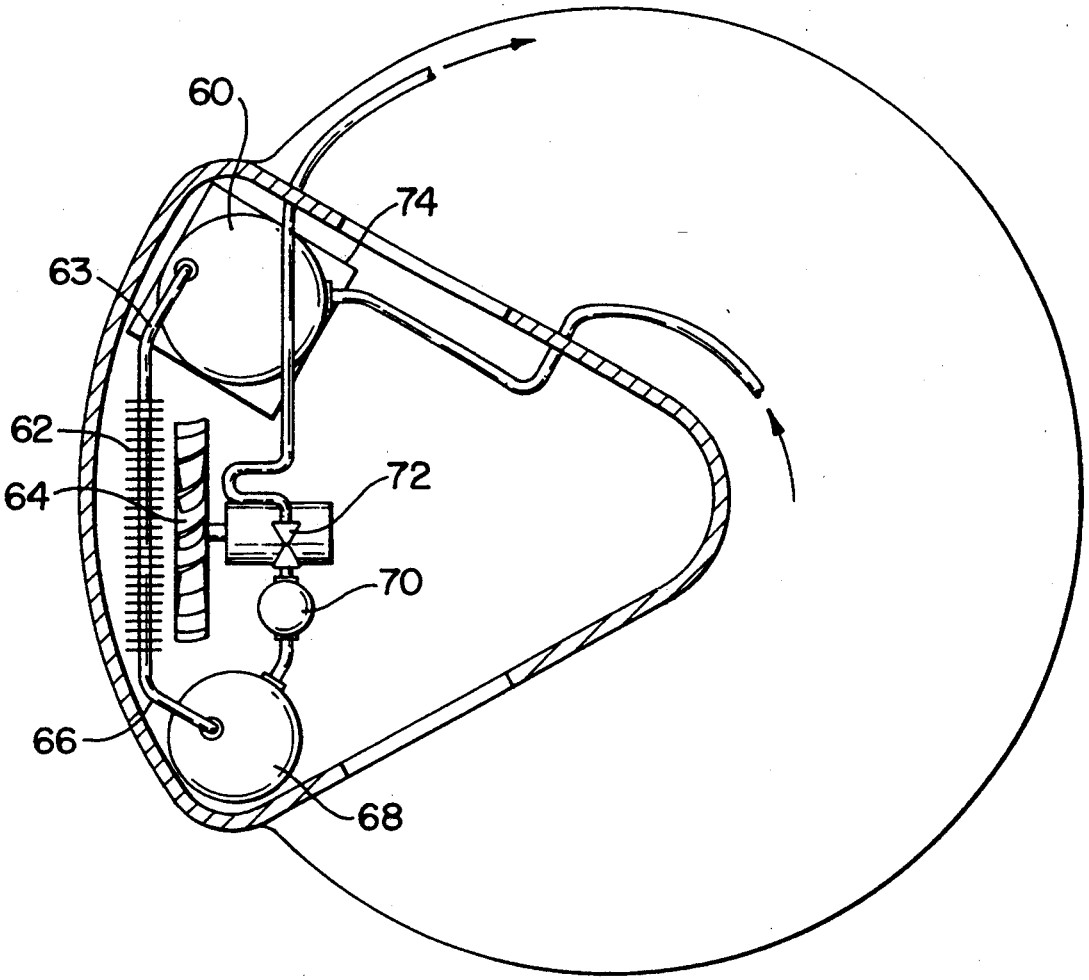
FIG. 5 is a cross sectional top view illustrating the layout of the refrigeration system.

Now referring to the drawings wherein like numerals represent like elements, FIGS. 1 and 2 set the top and side view respectively of the chilled service bowl 10 of the instant invention. The chilled service bowl utilizes a lightweight integral housing having a concave base bowl 12 operatively associated with a lightweight hollow support structure 14 which houses a miniaturized refrigeration system, described in detail later in this specification, for removing heat from the base bowl 12 and provides a pedestal 16 for the support of the base bowl 12.

The inner surface 18 of the base bowl 12 includes a plurality of through holes 20 along the bottom of base bowl providing an air intake for the refrigeration system. The outer surface 22 is generally hemispherical with an aperture 24 forming a directional opening along the circumference of the upper edge of the inner surface 18 of the base bowl 12 directly beneath the top edge 26 of the support structure 14.

The support structure 14 includes an enlarged area 28 for placement of miniaturized refrigeration components. Switch 30 provides temperature control and is conveniently mounted along the back portion of the support structure. Auxiliary intake 32 provides fresh air for circulation if the intake hole 20 of the base bowl are blocked.

Now referring to FIGS. 3 and 4, air circulation is pictorially illustrated. The inner surface 34 of the support structure 14 is spaced apart from the outer surface 36 of the base bowl 12 providing air circulation chamber 38. Evaporator coil 40 is juxtapositioned along the outer surface 36 of the base bowl 12 for chilling the inner surface 18 of the base bowl 12 by the removal of heat through the wall. Base bowl 12 materials of construction is preferably non-stick metal providing optimum heat transfer, however, it has been found that thin wall plastics are suitable. Air circulation forces air across the evaporator coil 40 through aperture 24 of the upper edge 42 of the inner surface 18 directly beneath the top edge 26 of the support structure 14. The aperture 24 having a curvature directing the circulate air toward the bottom of the base bowl 12. Based on the phenomenon of cold air sinking and hot air rising, warmed air rises out of the base bowl and the cold air sinks obtaining additional cooling from the inner surface 18 and is drawn into intake hole 20. An evaporator/circulation fan 44 is coupled to the intake holes 20 by intake chamber 46 providing an unobstructed intake to the circulation fan 44. Should the intake hole 20 be obstructed by food placed within the base bowl 12, or by insertion of a bowl liner to be described later in this specification, the circulation fan will draw outside air through auxiliary intake 32. Auxiliary intake 32 employs a felt, or the like filter-silencing material, allowing the suction of air therethrough with minimal resistance. Thus, if sufficient air is provided by through holes 20 then no air is drawn through the auxiliary intake 20. However, should portions of the primary intake 20 become obstructed then the circulation will cause a suction in the chamber 46 causing supplemental air to be pulled through the auxiliary intake 32. Conversely, if the primary intakes 20 are completely obstructed, the totality of air is made available to the circulation fan 44 through the auxiliary intake 32. It has been found that fan noise is shapely curtailed by use of intake holes wherein fruit placed within the base bowl 12 provide baffling. In addition, the felt liner placed on the inner surface of the opening 32 provides fan noise baffling in addition to the necessary air flow restriction. A mesh covers the auxiliary intake 32 to prevent touching the fan during operation.

In an alternative embodiment, the use of a conventional wire heating element 41 can be positioned between the evaporator coil 40 allowing the bowl to be used for heating of side dishes such as soup, potatoes, rice, cider, and the like. Use of the alternative embodiment is based upon a directional switch that either allows either the refrigeration system or the heating element to operate.

Circulation fan 44 slightly pressurizes the inner volume of the support structure 14 forcing the air into chamber 38 at aperture 48. In the event primary aperture 24 is blocked, auxiliary exhaust ports 50, see FIGS. 1 and 4, provide direct expulsion of air to prevent actual pressurization of the support structure 14. Using a similar air flow restriction as found with the auxiliary intake 32, the exhaust port 50 has a mesh cover to support a felt filter. In the event bowl liner is utilized, the exhaust ports 50 will expel all air that is circulated past the evaporator coil 40 providing a greater cooling environment within the cavity. It should be noted at this time that the circulation fan can be used to cool a low pressure refrigerate compressor as is used in the disclosed invention. However, if a larger service bowl is desired or colder temperatures, a separate chamber can be set forth in the support structure 14 for housing the condenser and a separate cooling fan, all of which is considered within the scope of this invention.

Now referring to FIG. 5, a small lightweight refrigeration system is disposed in the enlarged chamber using a compressor 60 operating on 115 voltage for compressing refrigerant gas such as R-22 for delivery to a condenser 62 by use of transfer tubing 63. The SANYO Corporation currently produces a miniaturized compressor which operates on 1.1 amps with a locked rotor rating of 2.75 amps although any compressor can be employed. As the compressor compresses a conventional finned radiator 62 is used for condensing the refrigerant gas into a liquid refrigerant. If a compressor larger than the 1.1 amp is utilized it is recommended that an optional cooling fan 64 ventilates the condenser coil through an optional exhaust port, shown in FIG. 8, along back wall 66. The liquid refrigerant is transferred through coupling line 66 to dryer 68 and stored in liquid accumulator 70. The accumulator 70 is followed by a capillary tubing 72 or needle valve for metering of the stored liquid refrigerant into an evaporator coil 40. The evaporator coil 40 mounted along the outer surface 36 of the base bowl 12 vaporizes the liquid refrigerant absorbing heat through the side wall of the base bowl 12. Circulating fan 44 removes excess heat from the condenser 66 and evaporator coil 40 for either recirculation or expulsion as previously described.

In operation, the compressor 60 raises the pressure of the refrigerant to about 100 psi in a vapor state so that its saturation temperature is higher than the temperature of the available cooling medium. The refrigerant is condensed by circulating air past the condenser coil 55 causing sufficient heat loss through condensation for storage in the accumulator as a liquid. The pressurized liquid is then metered 72 causing a drop in pressure wherein the liquid refrigerant cools itself within the evaporator coil 40 dropping approximately 80 psi before suction 74 at compressor 60. Fan 44 circulates the air throughout the enlarged chamber 28 exiting through aperture 48 for introduction in chamber 38 removing excess heat from coils 40. Switch 30 turns on the compressor motor allowing the pressure to rise in the system. Circulation fan 44 will operate continually although the compressor will cycle if a temperature sensor is employed, having a preferred placement along the directional aperture.

FIG. 6 and 6A sets forth a perspective view of the instant invention having a solid bowl liner 80 constructed of food grade materials which is available for slidable insertion into the base bowl 12 to permit placement of non-solid foods such as the fruit salads. The outer surface 82 of the bowl liner seals the direction opening 24 forcing air past the evaporator coil only once before compelled through exhaust ports 50. The bowl liner 80 can be easily removed for use as a conventional bowl. Condensation that may form on the outer surface 82 of the bowl 80 can fall through opening 24 onto a small drip pan located directly beneath the holes 24. When the bowl 80 is removed from the base bowl 12, the air flow through aperture 24 is resumed allowing for quick evaporation of condensation that may occur on the inner side surface of the base bowl 12. Another embodiment of the bowl liner is shown in FIG. 7 wherein a bottle holder 86 is formed into the bowl 88 having a formable seal 90 encompassing the bottle hole allowing automatic adjustment to the neck of any sized bottle 92 providing the bowl liner as a chilling chamber in place of a conventional bucket of ice. In this embodiment, the outer surface of the bowl includes a plurality of raised ridges 89 allowing air circulation from the upper aperture 24 to the lower intake holes 20. The circulation increasing the efficiency of the refrigeration system.

Figure 8:
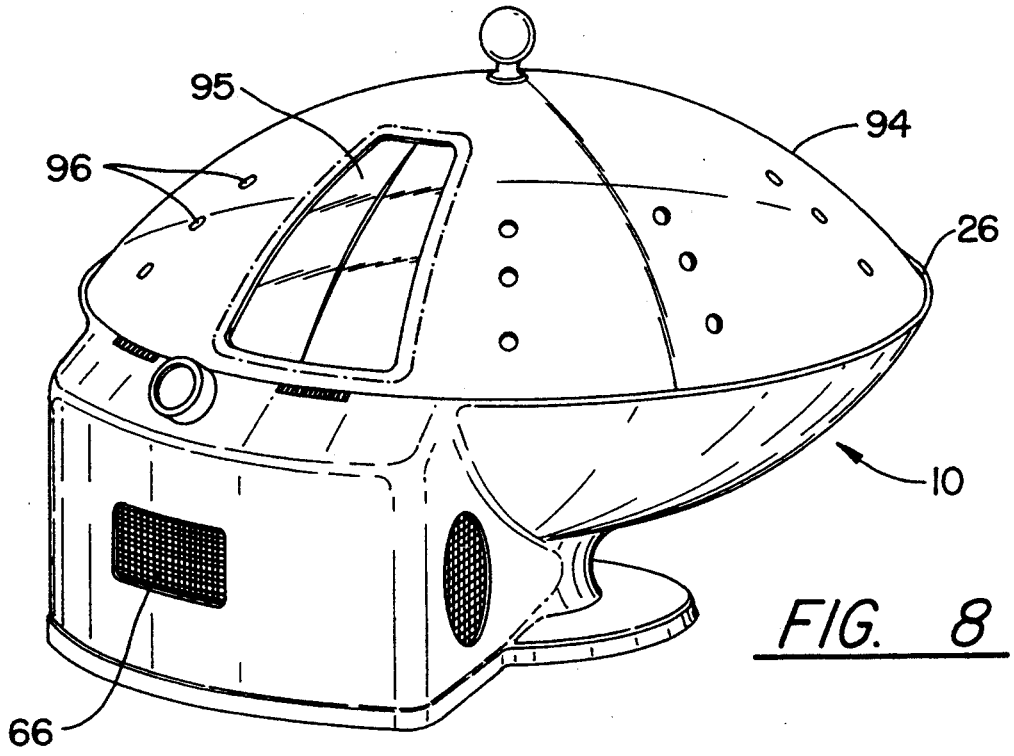
FIG. 8 is a perspective view with a cover installed.

Referring to FIG. 8, the instant invention is shown with a cover 94 which terminates along the outer periphery edge 26 and adaptable to slidably fit within the edge of the support structure for sealably attaching at an angle thereto. The cover 94 increases efficiency of the cooling system and allows continued air circulation if used without a bowl liner. Alternatively, when used in combination with the bowl liner, provides an internal temperature equaling that of a conventional refrigerator. A plurality of holes 96 prevent excess condensation when the cover 94 is in place. A formable seal 95 along a portion of the cover 94 allows the neck of any sized bottled beverage to extend therethrough.

Figure 9:
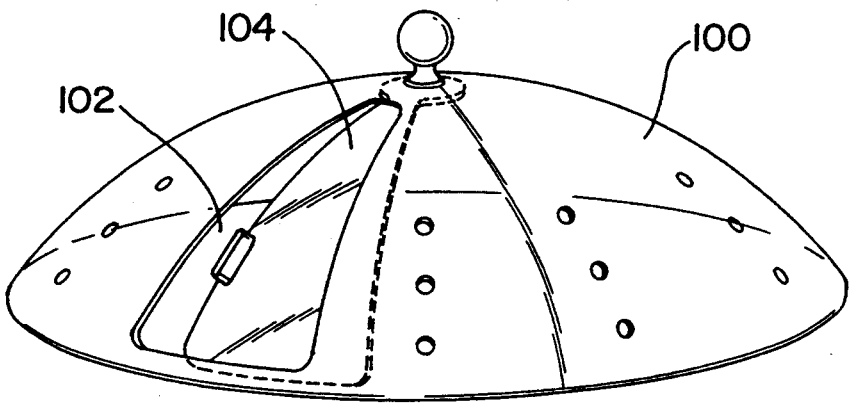
FIG. 9 is a perspective view of an optional cover having a slidable cover.

FIG. 9 sets forth an alternative cover 100 wherein opening 102 is provided by use of slidable door 104. In this embodiment the cover can be maintained in a fixed position on the fruit bowl. Access to the contents of the bowl is possible by insertion of a spoon or the like retrieval device through opening 102. The handle of the retrieval device may extend outward from the opening thus allowing efficiency in operation during the heating or cooling mode by elimination of the need to remove the cover during service.

The invention has been shown and described herein in what is considered to be the most practical and preferred embodiment. It is recognized, however, that departures may be made therefrom within the scope of the invention and that obvious modifications will occur to a person skilled in the art.

What is claimed is:

1. A chilled service bowl comprising: a concave generally hemispherical shaped base bowl having a peripheral edge defining an inner surface and an outer surface, said inner surface having a plurality of openings fluidly communicating said inner surface to a lower portion of said outer surface; a support structure for said bowl, said support structure spaced apart from said outer surface of said base bowl providing a chamber therebetween, said support structure having an enlarged chamber and operatively associated with said base bowl; refrigeration means disposed in said enlarged chamber; a liner bowl slidably insertable into said base bowl, said liner bowl including a means for obstructing said base bowl openings and said directional aperture and means for circulating air across said outer surface of said base bowl.

2. The chilled service bowl according to claim 1 wherein said liner bowl includes a means for securing at least one beverage bottle in a stationary position.

3. The chilled service bowl according to claim 1 including a cover operatively associated with said support structure terminating in an outer periphery adapted to slidably fit within said support structure and sealably attached at an angle thereto.

4. The chilled service bowl according to claim 1 wherein said refrigeration means comprises:

compressor means for compressing refrigerant gag;

condenser means fluidly coupled to said compressor means for condensing said refrigerant gas into a liquid refrigerant;

accumulating means fluidly coupled to said compressor means for accumulating said liquid refrigerant;

metering means fluidly coupled to said accumulating means allowing the liquid refrigerant in said accumulating means to escape through said metering means;

evaporating coil fluidly coupled to said metering means for receipt of said escaping liquid refrigerant for evaporation to produce a cooling effect, said evaporating coil fluidly coupled to said compressing means such that evaporated refrigerant can pass from said evaporating coil to said compressor means.

5. A chilled service bowl comprising:

compressor means for compressing refrigerant gas;

condenser means fluidly coupled to said compressor means for condensing said refrigerant gas into a liquid refrigerant;

accumulating means fluidly coupled to said compressor means for accumulating said liquid refrigerant;

metering means fluidly coupled to said accumulating means allowing the liquid refrigerant in said accumulating means to escape through said metering means;

evaporating means fluidly coupled to said metering means for receipt of said escaping liquid refrigerant for evaporation to produce a cooling effect, said evaporating coil fluidly coupled to said compressing means such that evaporated refrigerant can pass from said evaporating coil to said compressor means;

a concave generally hemispherical shaped base bowl having a peripheral edge defining an inner surface and an outer surface, said inner surface having a plurality of openings fluidly communicating said inner surface to a lower portion of said outer surface, said evaporating means juxtapositioned to said outer surface of said base bowl;

a support structure for said bowl, said support structure spaced apart from said outer surface of said base bowl providing a chamber therebetween, said support structure having an enlarged chamber for housing of refrigeration components, said enlarged chamber sealingly coupled to said openings of said base bowl, said support structure having a directional aperture formed by an inwardly curved upper edge disposed along the circumference of said support structure and at least one exhaust aperture diametrically opposed to said directional aperture;

a liner bowl constructed of food grade material and formed to be slidably insertable into said base bowl, said liner bowl including a means for obstructing said base bowl openings and said directional aperture; and means for restricting air flow through said auxiliary intake aperture and said exhaust aperture.

6. The chilled service bowl according to claim 1 including a cover operatively associated with said support structure terminating in an outer periphery adapted to slidably fit within said support structure and sealably attached at an angle thereto, said cover having at least one opening operatively associated therewith.

7. The chilled service bowl cover according to claim 6 wherein said opening is further defined as a slidable door.

* * * * *